US005363761A

United States Patent [19]

Galassi

[11] Patent Number: 5,363,761

[45] Date of Patent: Nov. 15, 1994

[54] PLATE INKING DEVICE

[75] Inventor: Angelo Galassi, Milan, Italy

[73] Assignee: Tampograf S.a.s. di J.E. Taylor & Co., Milan, Italy

[21] Appl. No.: 22,512

[22] Filed: Feb. 25, 1993

[30] Foreign Application Priority Data

Apr. 30, 1992 [IT] Italy ..... MI92A001037

[51] Int. Cl.[5] ..... B41F 1/42

[52] U.S. Cl. ..... 101/163; 101/167; 101/123; 101/338; 101/364

[58] Field of Search ..... 101/163, 167, 169, 123, 101/124, 335, 337–339, 343–347, 363, 366, 364

[56] References Cited

U.S. PATENT DOCUMENTS

| | | | |
|---|---|---|---|
| 3,622,058 | 11/1971 | Vits | 101/228 |
| 5,222,433 | 6/1993 | Philipp | 101/163 |
| 5,237,922 | 8/1993 | Ho | 101/163 |

FOREIGN PATENT DOCUMENTS

| | | | |
|---|---|---|---|
| 0140165 | 9/1984 | European Pat. Off. . | |
| 0473947 | 11/1992 | European Pat. Off. . | |
| 2205430 | 6/1981 | Germany | 101/163 |
| 006932 | 10/1990 | Germany . | |
| 59-192571 | 10/1984 | Japan . | |

*Primary Examiner*—Edgar S. Burr
*Assistant Examiner*—Lynn D. Hendrickson
*Attorney, Agent, or Firm*—Fitzpatrick, Cella, Harper & Scinto

[57] ABSTRACT

An inking device effective to provide a faultless ink-tight fit comprises a sheet-like support for a plate, and a cartridge, similar in shape to an overturned glass, which is adapted to contain an ink and has a lip in liquid-tight doctoring engagement with the plate, wherein the cartridge has a ring formed from a zirconia-containing ceramic material and provided with a sharp edge constituting the lip.

5 Claims, 1 Drawing Sheet

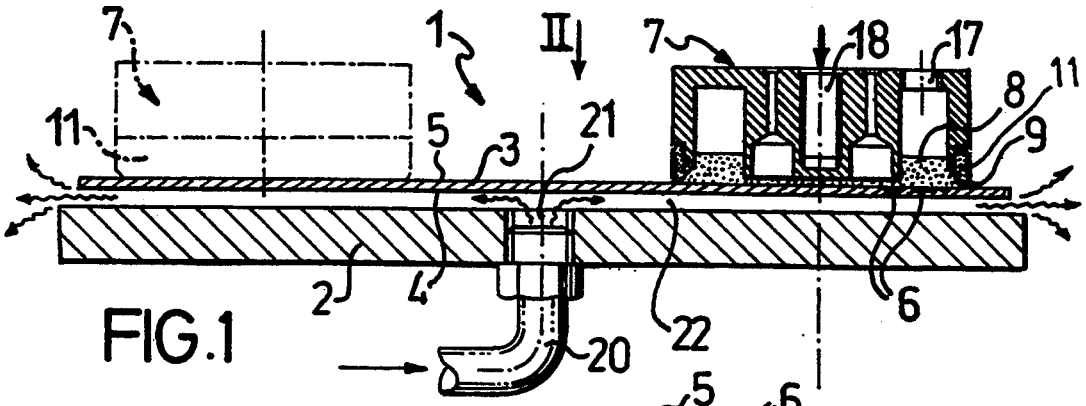
FIG.1
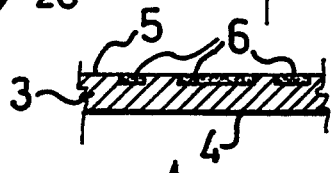
FIG.3
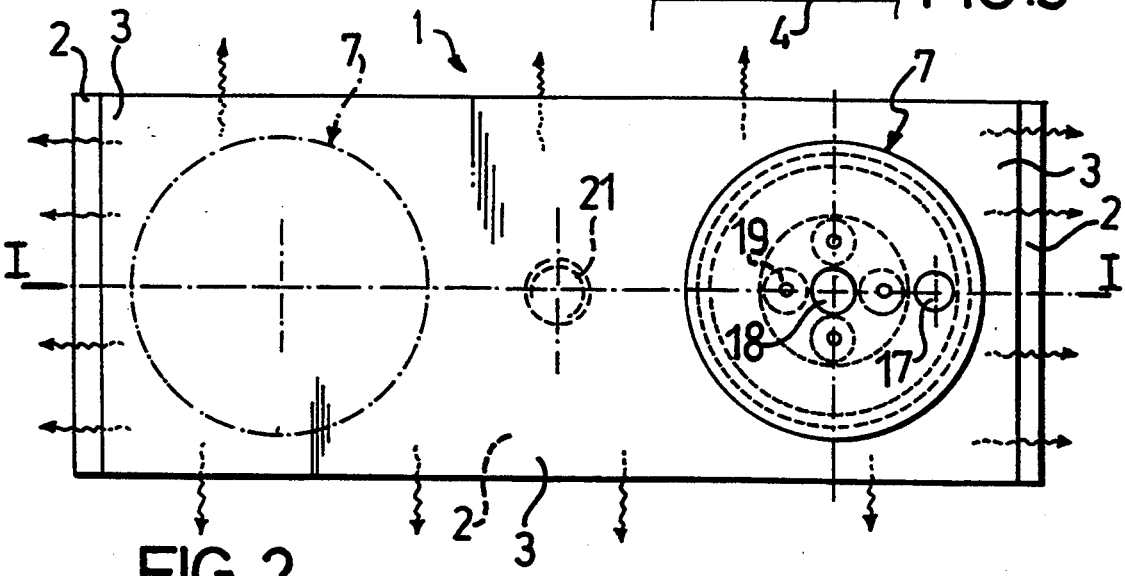
FIG.2
FIG.5
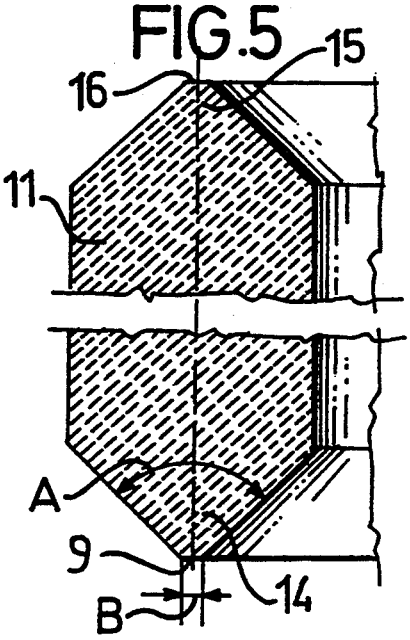
FIG.4
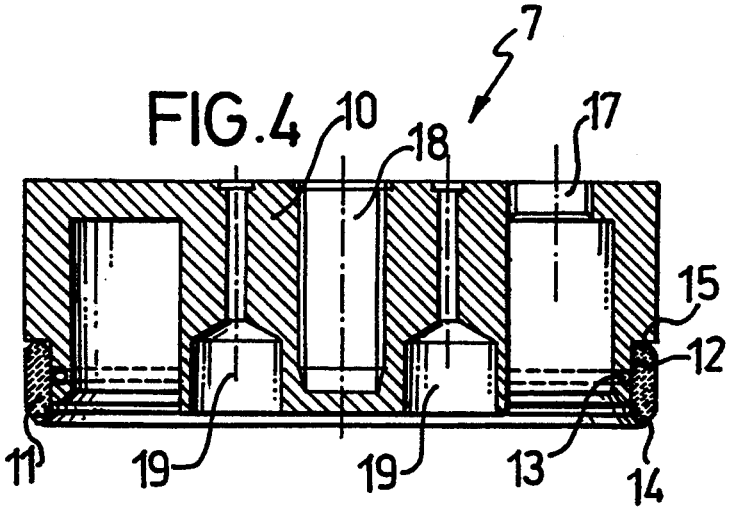

PLATE INKING DEVICE

BACKGROUND OF THE INVENTION

1. Field of the Invention

This invention relates to a plate inking device of a type which comprises a sheet-like support for a plate and a cartridge, similar to an overturned glass in shape, adapted to contain an ink and having a lip in liquid-tight doctoring engagement with said plate.

2. Description of the Related Art

Conventional devices of this kind, while being satisfactory from several aspects and extensively used, still are deficient in the matter of environmental protection.

In fact, a continual grievance is in this respect that in the course of the relative movement of the cartridge and the plate, during a desired step of filling the plate receptacles with ink, the lip allows some ink to escape and release substantially objectionable vapors which build up as the operation progresses.

The underlying problem of this invention is to provide an inking device which has such construction and operational features as to overcome the above drawback.

SUMMARY OF THE INVENTION

This problem is solved by an inking device as indicated being characterized in that said cartridge includes a ring of a ceramic material having a sharp edge which constitutes said lip and further characterized in that said ring is constructed to be mounted in a releasable fashion and is formed with an oppositely located sharp edge to provide a spare lip.

BRIEF DESCRIPTION OF THE DRAWINGS

Further features and the advantages of an inking device according to the invention will become apparent from the following detailed description of a preferred embodiment thereof, given by way of example and not of limitation with reference to the accompanying drawings, in which:

FIG. 1 is a schematic view showing an inking device according to the invention, in elevation and in section along line I—I:

FIG. 2 is a plan view, taken in the direction of arrow II, of the device in FIG. 1;

FIG. 3 is a sectional view, drawn to a much enlarged scale, of a detail of the device in FIG. 1;

FIG. 4 is a sectional view, drawn to an enlarged scale, of another detail of the device in FIG. 1; and FIG. 5 shows the detail of FIG. 4 to a further enlarged scale.

DETAILED DESCRIPTION OF THE PREFERRED EMBODIMENTS

With reference to the accompanying drawing figures, generally shown at 1 is a plate inking device.

The device 1 comprises a sheet-like support 2 for a plate 3.

The plate 3 has a small thickness dimension and is substantially pliable; it also has a lower surface 4, an upper surface 5, and receptacles 6 adapted to become filled with ink.

The device 1 further includes a cartridge 7, also referred to as the fountain, which is similar to an overturned glass in shape. This is intended to contain an ink supply 8 and has a lip 9 which is held in ink-tight pressure contact with the plate 3 by conventional pressure means, not shown.

Also conventionally, the cartridge 7 and the support 2 with its associated plate 3 are kept in relative motion, whereby the lip 9 will engage the plate 3 doctoring blade-fashion to scrape any excess ink off the upper surface 5 of the plate and only leave ink in the receptacles 6.

It should be noted that the cartridge 7 has a body 10, in the shape of an overturned glass, which is formed from a suitable aluminum alloy, such as Anticorodal, and a tubular ring 11 being a releasable force fit in a peripheral recess 12 which is formed at the location of the free edge of the body 10. A seal 13 placed between the ring 11 and the body 10 ensures ink-tight engagement.

The ring 11 has a sharp end edge 14 which constitutes the lip 9.

An opposite end edge 15 of the ring 11 is also made sharp and constitutes a spare lip 16.

The sharpening results in the cross-sectional shape of the lips 9 and 16 being a "V" with a spread angle A, e.g. of 90 degrees, and an apex flattened into a segment having a length B of 0.1 mm, for example.

The ring 11 is formed, in accordance with the invention, from a ceramic material, preferably a zirconia-containing material.

The cartridge 7 is completed with an ink supply hole 17, a pressure means holder 18, and sockets 19 adapted to receive magnetic inserts, not shown, for holding the plate 3 against the cartridge 7 while the pressure means are disengaged.

Indicated at 20 is a supply conduit for pressurized air, which conduit is associated with the support 2 and opens, through a nozzle 21, into the gap between the support 2 and the lower surface 4 of the plate 3 to create an air cushion or bed 22 between the support and the plate.

In operation, during the relative movement of the cartridge and the support with its plate, the lip 9 is held against the plate 3 by the pressure means, to thereby provide an ink-tight fit and act as a doctoring blade across the upper surface 5 of the plate. The air cushion ensures a perfectly true fit of the plate against the lip.

It has been found that the device of this invention can provide a faultlessly ink-tight fit and virtually no, or only very low, wear of the lip, with the attendant advantage of improved operation from the environmental standpoint due to the release of objectionable vapors being practically zero.

In addition, this device is expected to be economically favorable from the standpoint of service durability, which should now be greatly enhanced both on account of the lip wear being in the first place almost nil and of the spare lip provided.

Another advantage comes from that the device construction is also made straightforward by the lip sharpening being now carried out on a member, the ring, which is structurally quite simple, and the support being machinable to less stringent planarity tolerances by virtue of the air cushion provided.

Ease of maintenance and reduced downtime in operation of the device are further enhanced by that the ring can be readily overturned to bring to work the spare lip, and that the ring may be exchanged with other rings from a supply kept at hand for use where necessary.

A further advantage of the device according to the invention resides in the increased speed at which the relative movement of the cartridge and the plate can take place to improve the throughput rate.

Understandably, a skilled person in the art may introduce many changes and modifications to the device described in the foregoing, in order to meet contingent and specific demands, without departing from the scope of the invention as defined in the appended claims.

I claim:

1. A plate inking device of a type which comprises a sheet-like support for a plate and a fountain cartridge adapted to contain ink and having a lip in liquid-tight doctoring engagement with said plate, said cartridge including a ring of ceramic material having a sharp edge which constitutes said lip, said ring being mounted in a releasable fashion and formed with an oppositely located sharp edge to provide a spare lip.

2. A device according to claim 1, characterized in that said ceramic material contains zirconia.

3. A device according to claim 1, characterized in that it includes a pressurized air supply line associated with the sheet-like support and enabling an air cushion to be created between the support and the plate.

4. A ceramic material ring, for association with a fountain cartridge of a plate inking device, said ring having a first sharp edge adapted to provide a lip in liquid-tight doctoring engagement with the plate and said ring being further formed with an oppositely located sharp edge to provide a spare lip.

5. A ring according to claim 4, characterized in that said ceramic material contains zirconia.

* * * * *